US008061569B2

(12) United States Patent
Sugita et al.

(10) Patent No.: US 8,061,569 B2
(45) Date of Patent: Nov. 22, 2011

(54) CLIP AND HANGER WITH THE SAME

(75) Inventors: Haruo Sugita, Tokyo (JP); Kiyoshi Sugita, Tokyo (JP)

(73) Assignee: Taya Company Limited, Tokyo (JP)

( * ) Notice: Subject to any disclaimer, the term of this patent is extended or adjusted under 35 U.S.C. 154(b) by 0 days.

(21) Appl. No.: 12/160,361

(22) PCT Filed: Jan. 9, 2007

(86) PCT No.: PCT/JP2007/050066

§ 371 (c)(1),
(2), (4) Date: Jul. 9, 2008

(87) PCT Pub. No.: WO2007/080845

PCT Pub. Date: Jul. 19, 2007

(65) Prior Publication Data

US 2010/0258599 A1 Oct. 14, 2010

(30) Foreign Application Priority Data

Jan. 13, 2006 (JP) ..... P2006-006269
Apr. 24, 2006 (JP) ..... P2006-119557

(51) Int. Cl.
*A41D 27/22* (2006.01)

(52) U.S. Cl. ..... 223/96; 223/91

(58) Field of Classification Search ..... 223/85, 223/90, 91, 93, 96, DIG. 2
See application file for complete search history.

(56) References Cited

U.S. PATENT DOCUMENTS

| | | | | |
|---|---|---|---|---|
| 2,483,303 | A * | 9/1949 | Rysick | 223/96 |
| 4,335,838 | A | 6/1982 | Bisk et al. | |
| 4,763,390 | A * | 8/1988 | Rooz | 223/93 |
| 4,878,276 | A * | 11/1989 | Morrish et al. | 223/96 |
| 5,398,854 | A | 3/1995 | Blanchard | |
| 5,810,217 | A * | 9/1998 | Ohsugi | 223/85 |
| 6,863,197 | B1 | 3/2005 | Dirlam et al. | |

FOREIGN PATENT DOCUMENTS

| | | |
|---|---|---|
| CN | 87201266 | 3/1988 |
| CN | 2184009 | 11/1994 |
| JP | 55-001451 | 1/1980 |
| JP | 61-019377 | 2/1986 |
| JP | 61-090465 | 6/1986 |
| JP | 01-07748 | 5/1989 |
| JP | 2004237038 | 8/2004 |
| RU | 2 120 222 | 10/1998 |
| SU | 196 641 | 5/1967 |
| WO | 81/02827 | 10/1981 |

* cited by examiner

*Primary Examiner* — Nathan Durham

(74) *Attorney, Agent, or Firm* — Gottlieb, Rackman & Reisman P.C.

(57) ABSTRACT

A clip for clamping an object (25) has a clip body (5) where a pair of clip members (1, 2) are pivotally connected to each other, clamping force increasing members (6, 7) for increasing a clamping force of the clip body; and fixing means (8) for supporting the clamping force increasing members on the clip body. The clamping force increasing members have slip prevention sections (6*a*, 7*a*) disposed between leading ends of the clip body and clamped by the clip body together with the object, and have also transmission sections (6*b*, 7*b*) connected to the slip prevention sections and fixed to the clip members by the fixing means, to cause the friction force that the slip prevention sections receive from the object to be transmitted to the clip body.

10 Claims, 18 Drawing Sheets

CLIP AND HANGER WITH THE SAME

BACKGROUND OF THE INVENTION

1. Field of Invention

The present invention relates to a clip and to a hanger comprising the clip.

2. Description of the Related Prior Art

Clothing articles such as skirts, trousers and the like are transported and displayed while clamped by clips provided in hangers. The clothing article is likely to fall off when using a clip having insufficient clothing clamping force. On the other hand, using a clip having an excessive clothing clamping force gives rise to marks at the portions of the clothing article clamped by the clip, while making it harder to remove the clothing article from the clip.

Increasing the force with which the clothing article is clamped, and enlarging the surface area over which the clothing article and the clip come into contact, to increase the friction force therebetween, are known means for preventing the clothing article from falling off (see Patent document 1).

Patent document 1: Japanese Unexamined Patent Application Laid-open No. 2004-237038

BRIEF SUMMARY OF THE INVENTION

In clips using conventional means such as those described above, however, the force with which an object (clothing, curtains and the like) is clamped is determined chiefly by the elastic force of an elastic member such as a spring or the like provided in the clip. The clamping force of the clip does not increase therefore when a clothing article is pulled away from the clip.

An object of the present invention is to provide a clip whose clamping force increases when an object clamped by the clip is pulled away from the clip.

The clip of the present invention is a clip for clamping an object, comprising: a clip body in which a pair of clip members are pivotally connected to each other; a clamping force increasing member for increasing a clamping force of the clip body; and fixing means for supporting the clamping force increasing members on the clip body, wherein the clamping force increasing member has a slip prevention section, disposed between leading ends of the clip body and clamped by the clip body together with the object, and a transmission section connected to the slip prevention section and fixed by the fixing means to at least one clip member of the pair of clip members, and the fixing means transmits to the clip body, via the transmission section, a friction force that the slip prevention section receives from the object. In the clip of the present invention, the side at which the object is clamped is referred to as the leading end side, and the opposite side thereof is referred to as the base end side. As regards positions in the clip, the portion at which the object is clamped is referred to as the leading end, while the portion that is gripped for opening the leading end is referred to as the base end.

The present invention provides thus a clip whose clamping force increases when an object clamped by the clip is pulled away from the clip. The clip according to the present invention can effectively prevent a clothing article from coming off the clip. In addition, the clamping force of the clip of the present invention can be made to increase temporarily, which as a result allows sufficiently suppressing formation of marks on the portions of the clothing article clamped by the clip. The present invention provides also a hanger comprising the above-described clip.

EXPLANATIONS OF NUMERALS

1, 2, 71, 72, 81, 82 . . . clip members; 5, 75, 85 . . . clip body; 6, 7, 26, 27, 36, 37, 46, 47, 56, 66, 76, 77, 86, 87, 106 . . . clamping force increasing members; 103*a* . . . rods (both ends); 10, 20, 30, 40, 50, 60, 70, 80, 90, 100, 150 . . . clip; 120, 130 . . . hanger

DETAILED DESCRIPTION OF THE INVENTION

Preferred embodiments of the clip of the present invention are explained in detail below with reference to accompanying drawings.

Figure 1:
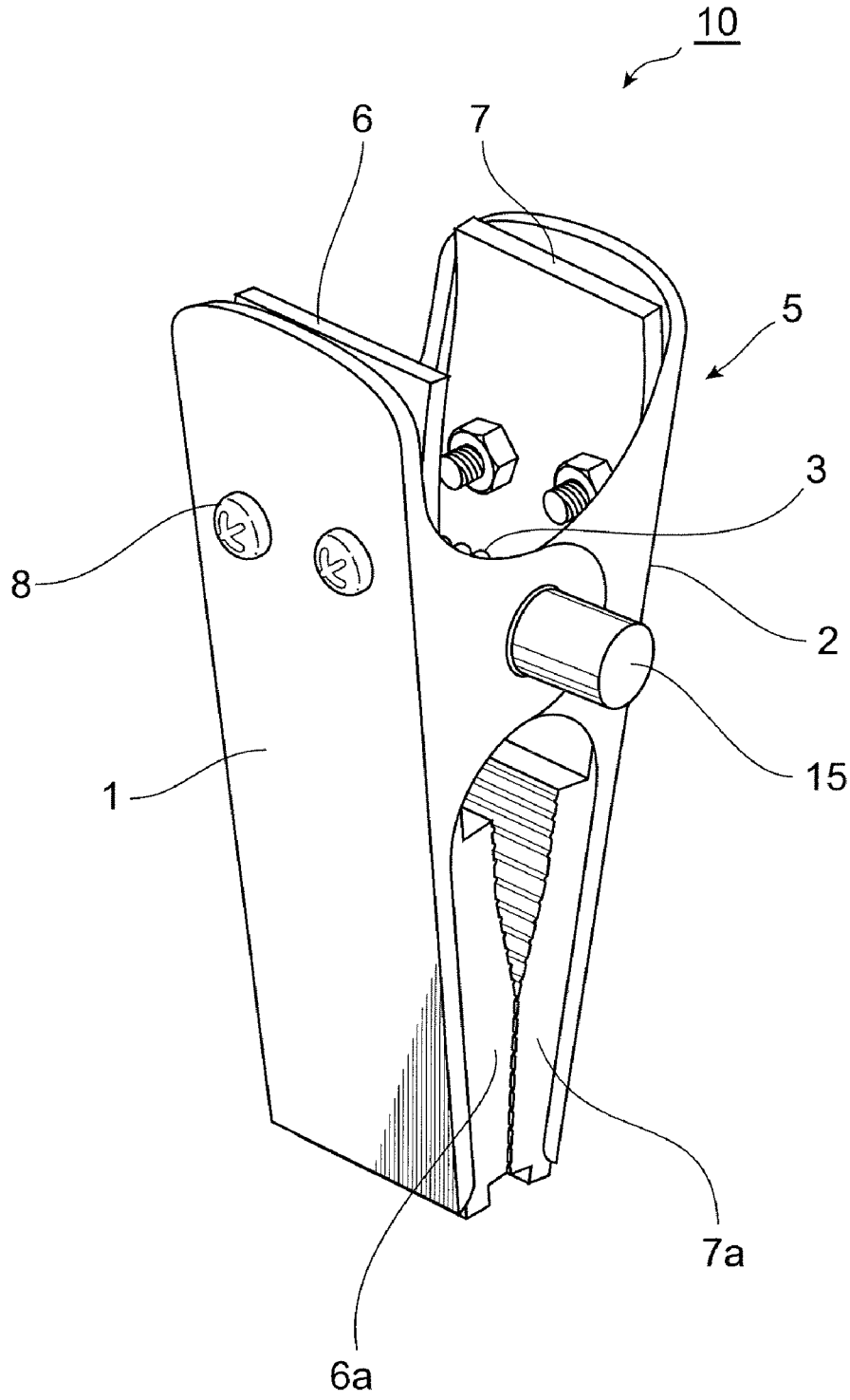
FIG. 1 is a perspective-view diagram illustrating a first embodiment of the clip according to the present invention.
Figure 2:
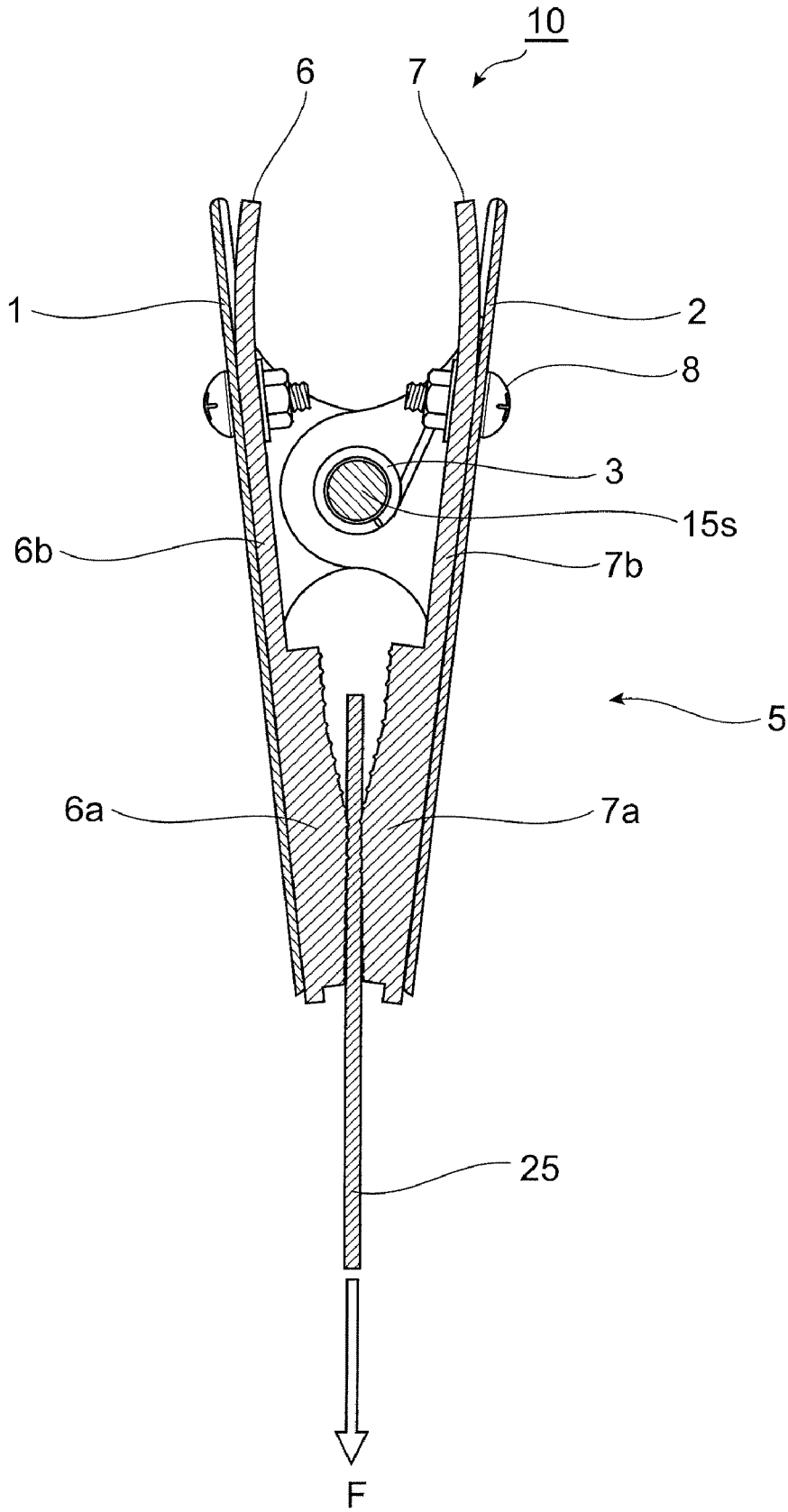
FIG. 2 is a cross-sectional diagram illustrating the first embodiment of the clip according to the present invention when clamping an object.

FIG. 1 is a perspective-view diagram illustrating a first embodiment of the clip of the present invention. FIG. 2 is a cross-sectional diagram of a clip 10 according to the present embodiment, when clamping an object. The clip 10 comprises a clip body 5, in which a pair of clip members 1, 2 are pivotally connected to each other, and a pair of clamping force increasing members 6, 7 that increases the clamping force of the clip body 5. The clamping force increasing member 6 has a slip prevention section 6*a* disposed between the pair of clip members 1, 2, and a transmission section 6*b* for transmitting to the clip member 1 the friction force that the slip prevention section 6*a* receives from an object 25. Similarly, the clamping force increasing member 7 has a slip prevention section 7*a* disposed between the pair of clip members 1, 2, and a transmission section 7*b* for transmitting to the clip member 2 the friction force that the slip prevention section 7*a* receives from an object 25. The clamping force increasing members 6, 7 are disposed extending along the inner faces of the clip members 1, 2 by way of respective screws 8 (fixing means) provided in the transmission sections 6*b*, 7*b*.

The slip prevention sections 6*a*, 7*a* are slidably provided along the inward faces of the clip members 1, 2, respectively. Herein, sliding refers to motion while maintaining contact. The slip prevention sections 6*a*, 7*a*, which are provided at mutually opposing positions, clamp the object 25 on account of a pressing force received from the clip members 1, 2. Providing the slip prevention sections 6*a*, 7*a* as described above is advantageous in that the object 25 can be fitted easily thereby between the slip prevention sections 6*a*, 7*a*.

A pressing force for clamping the object 25 is exerted on the clip members 1, 2. This pressing force is generated by a spring 3 disposed between the clip members 1, 2. The clip members 1, 2 are pivotally connected by way of a core rod 15 in which there is formed a pivot fulcrum 15*s*. Herein, pivoting denotes circular motion, in the forward and reverse directions, around the pivot fulcrum as the center of the circular motion.

The clamping force of the clip body 10 increases when the clip 10 exerts on the object 25 a force F (hereinafter, referred to as "pulling force on the object") in a direction bearing away from the pivot fulcrum 15*s*. The mechanism by which the clamping force is increased is explained next with reference to FIG. 3.

Figure 3:
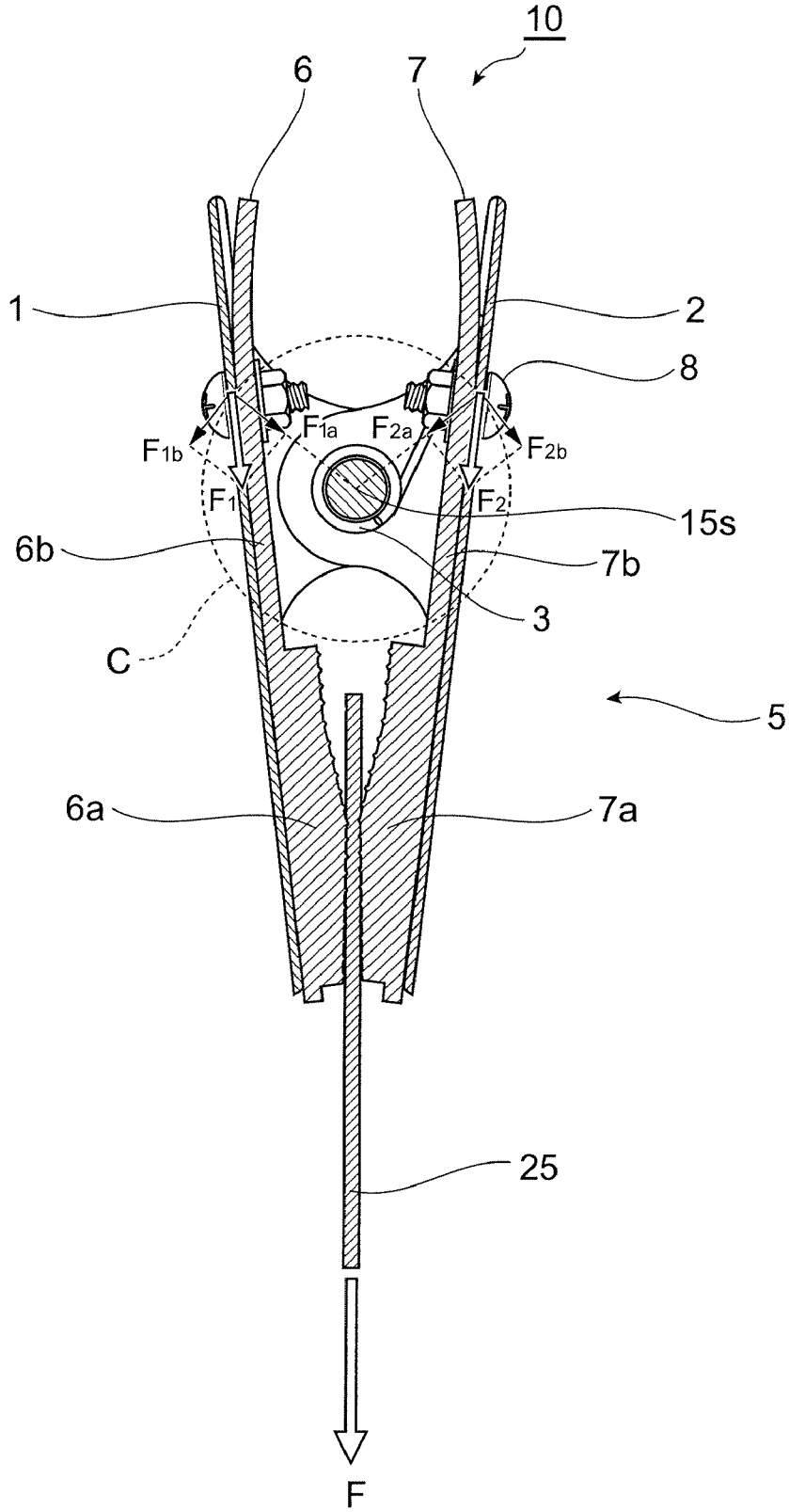
FIG. 3 is a diagram explaining the mechanism of the clip according to the present invention.

FIG. 3 is a cross-sectional diagram illustrating the forces exerted on the clip body 5 upon generation of a force F that pulls the object. The friction force generated in the slip prevention sections 6*a*, 7*a* by the force F pulling the object 25 is transmitted to the clip members 1, 2 via the transmission sections 6*b*, 7*b*. That is because the clip members 1, 2 and the clamping farce increasing members 6, 7 are respectively fixed to the transmission sections 6*b*, 7*b*, while the slip prevention sections 6*a*, 7*a* are slidably provided along the clip members 1, 2, respectively. Therefore, the clip members 1, 2 receive respectively, from the clamping force increasing members 6, 7, pulling forces F.sub.1, F.sub.2, in the leading end direction. As illustrated in FIG. 3, the pulling force F.sub.1 can be resolved into a force F.sub.1*a* in the direction of the pivot fulcrum 15*s* and a force F.sub.1*b* in the tangential direction of a circle C having the pivot fulcrum 15*s* at its center. Similarly, the pulling force F.sub.2 can be resolved into a force F.sub.1*a* in the direction of the pivot fulcrum 15*s* and a force F.sub.2*b* in the tangential direction of the circle C having the pivot fulcrum 15*s* at its center. The forces F.sub.1*b*, F.sub.2*b* in the tangential direction are both forces that cause the clip members 1, 2 to rotate in the direction in which the object 25 is fastened. Such a mechanism increases the clamping force of the clip body 5.

The clamping force increasing members 6, 7 of the clip 10 are respectively supported on the clip members 1, 2 by screws 8. The screws 8 that fix respectively the clip members 1, 2 and the transmission sections 6*b*, 7*b* are provided more toward the base end side of the clip body 5 than the pivot fulcrum 15*s*. The screws 8 need not necessarily be provided on the base end side. Other than screws, examples of fixing means for supporting the clamping force increasing members on the clip members include, for instance, bonding using an adhesive agent, crimping by way of metal members provided on the clip members, or engaging of openings formed in the transmission sections with hooks provided in the clip members.

The friction between the clip member 1 and the slip prevention section 6*a*, and between the clip member 2 and the slip prevention section 7*a*, are preferably small. Therefore, a member comprising a material having a low coefficient of friction may be disposed at the portions where the clip members 1, 2 and the slip prevention sections 6*a*, 7*a* come into respective contact, or there may be used a mechanism such that the slip prevention sections 6*a*, 7*a* slide smoothly over the clip members 1, 2. On the other hand, the surfaces at which the slip prevention sections 6*a*, 7*b* and the object 25 come into contact exhibit preferably substantial friction with the object. Hence, such surfaces have preferably formed thereon plural grooves. A flexible vinyl-based material can be used as the material of the clamping force increasing members 6, 7.

Although the clip 10 has two clamping force increasing members 6, 7, a single clamping force increasing member may be supported on one of the clip members. In terms of achieving the purpose of the present invention effectively and reliably, however, the pair of clamping force increasing members is preferably supported on respective individual clip members, as in the clip 10.

Figure 4:
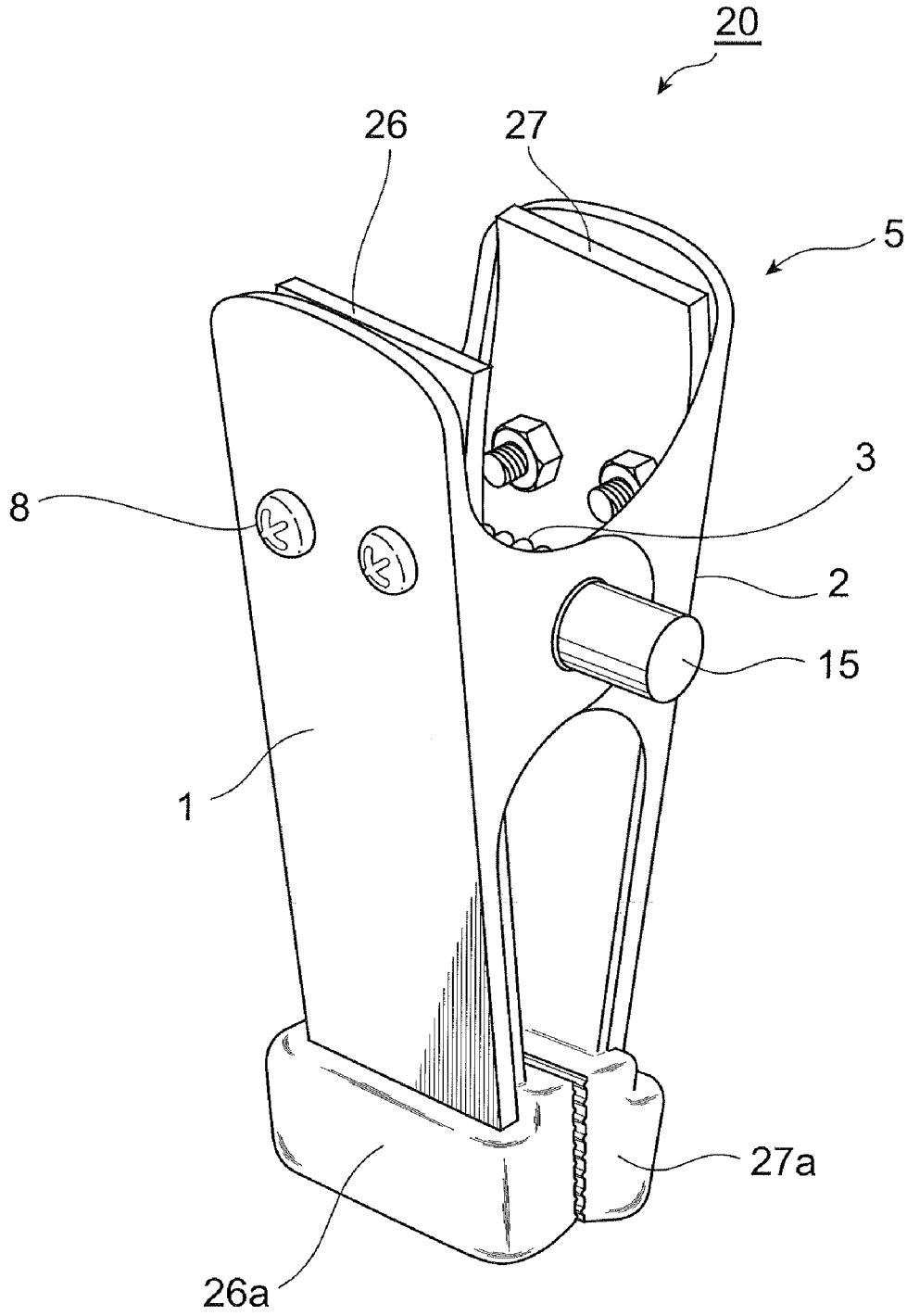
FIG. 4 is a perspective-view diagram illustrating a second embodiment of the clip according to the present invention.
Figure 5:
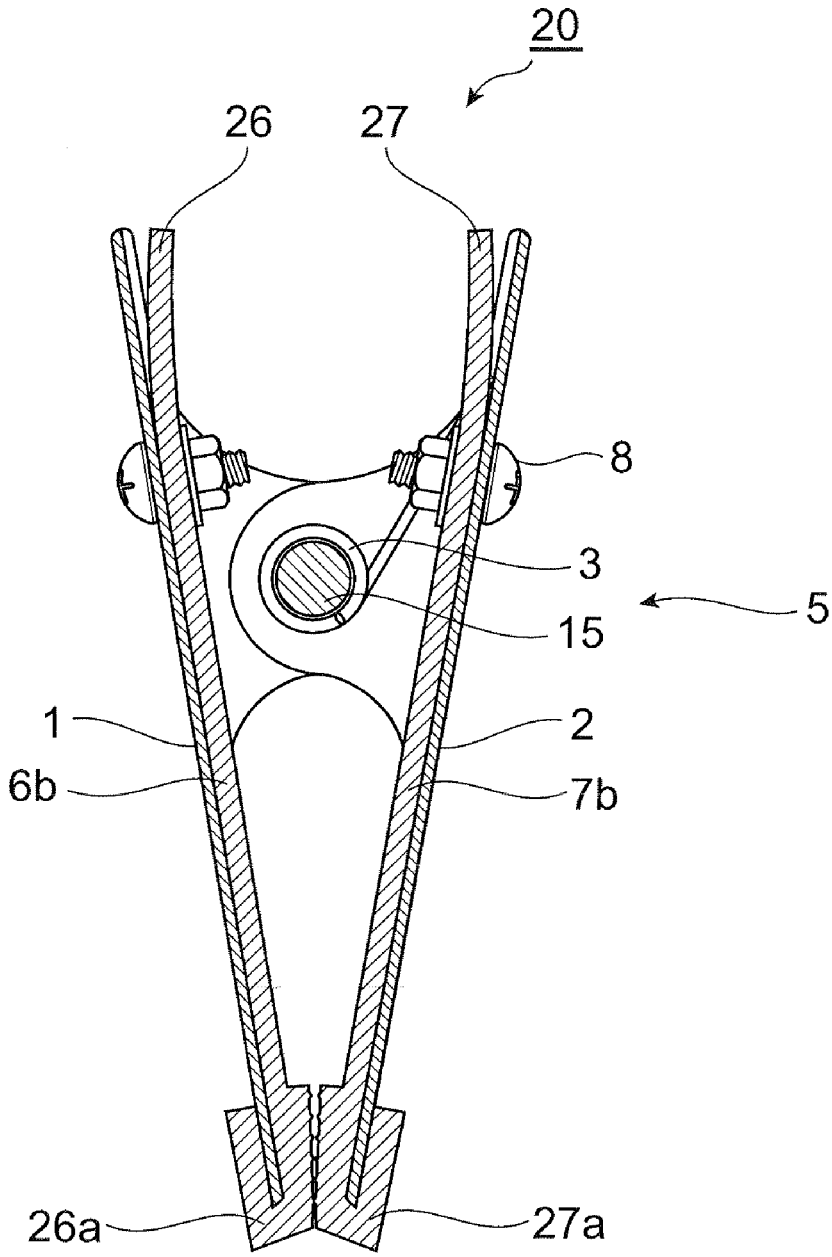
FIG. 5 is a cross-sectional diagram illustrating the second embodiment of the clip according to the present invention.

FIG. 4 is a perspective-view diagram illustrating a second embodiment of the clip of the present invention, and FIG. 5 is a cross-sectional diagram of a clip 20 according to the embodiment. A pair of clamping force increasing members 26, 27 of a clip 20 according to the present embodiment has slip prevention sections 26*a*, 27*a* formed so as to cover part of the leading ends of the clip members 1, 2. Except for the clamping force increasing members, the clip 20 can be constructed in the same way as the clip 10.

Figure 6:
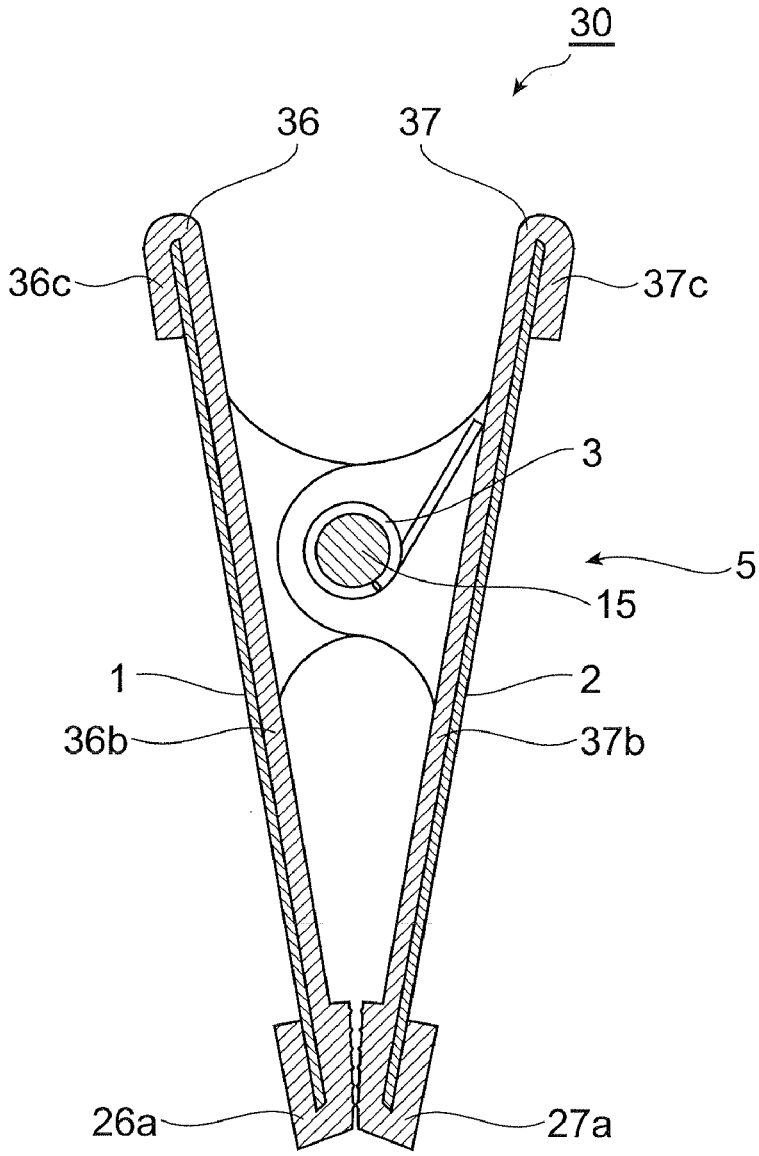
FIG. 6 is a cross-sectional diagram illustrating a third embodiment of the clip according to the present invention.
Figure 7:
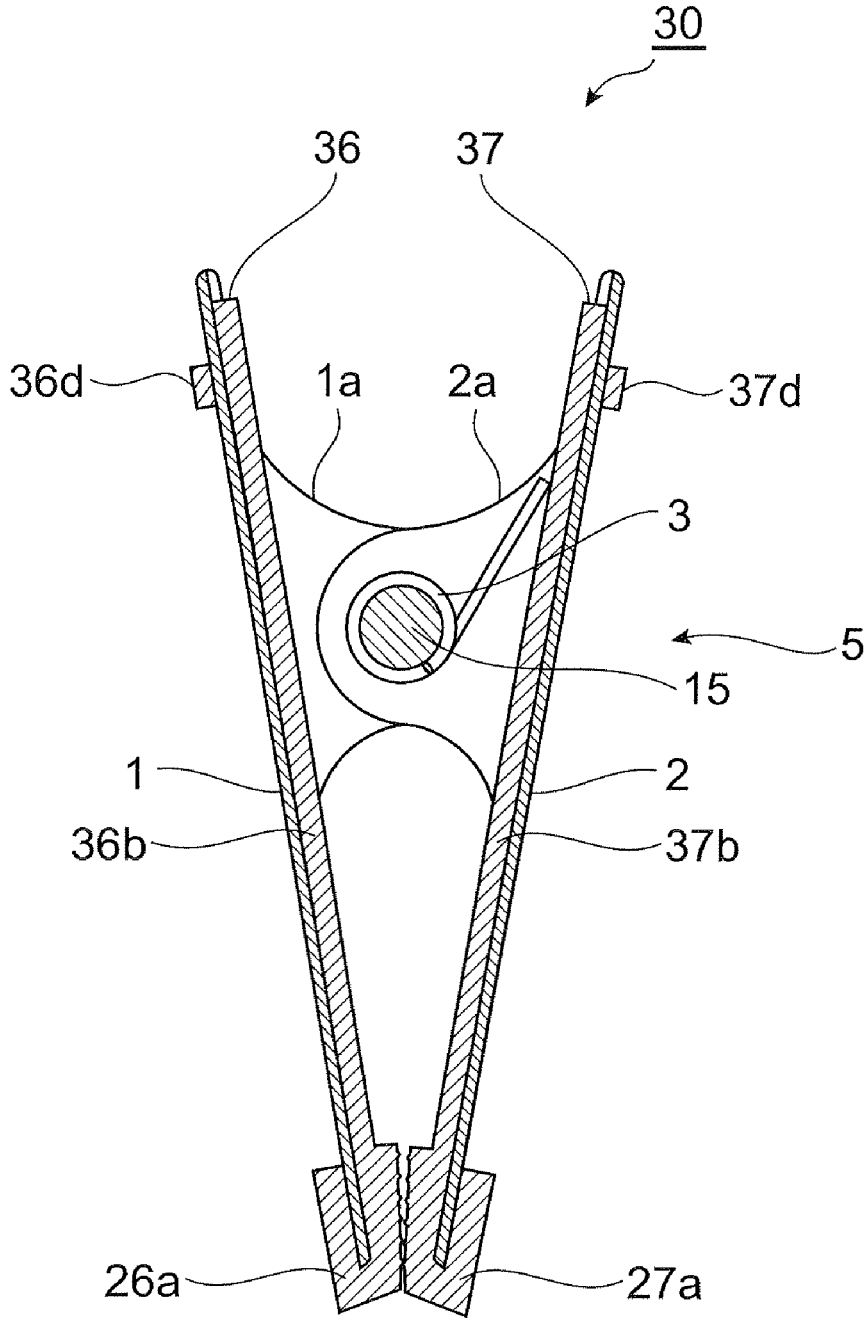
FIG. 7 is a cross-sectional diagram illustrating a modification of the third embodiment of the clip according to the present invention.

FIG. 6 is a cross-sectional diagram illustrating a third embodiment of the clip of the present invention. A pair of clamping force increasing members 36, 37 of a clip 30 according to the present embodiment comprises, on the base end sides of transmission sections 36*b*, 37*b*, fixing means 36*c*, 37*c* formed so as to cover part of the base end sides of the clip members 1, 2. Otherwise, the constitution of the clip 30 is identical to that of the clip 20. As fixing means there may be respectively provided, on the clamping force increasing members 36, 37, band-like members 36*d*, 37*d* that are fastened to rising sections 1*a*, 2*a* in the central direction of the clip members having openings for inserting the core rod 15, as illustrated in FIG. 7.

Figure 8:
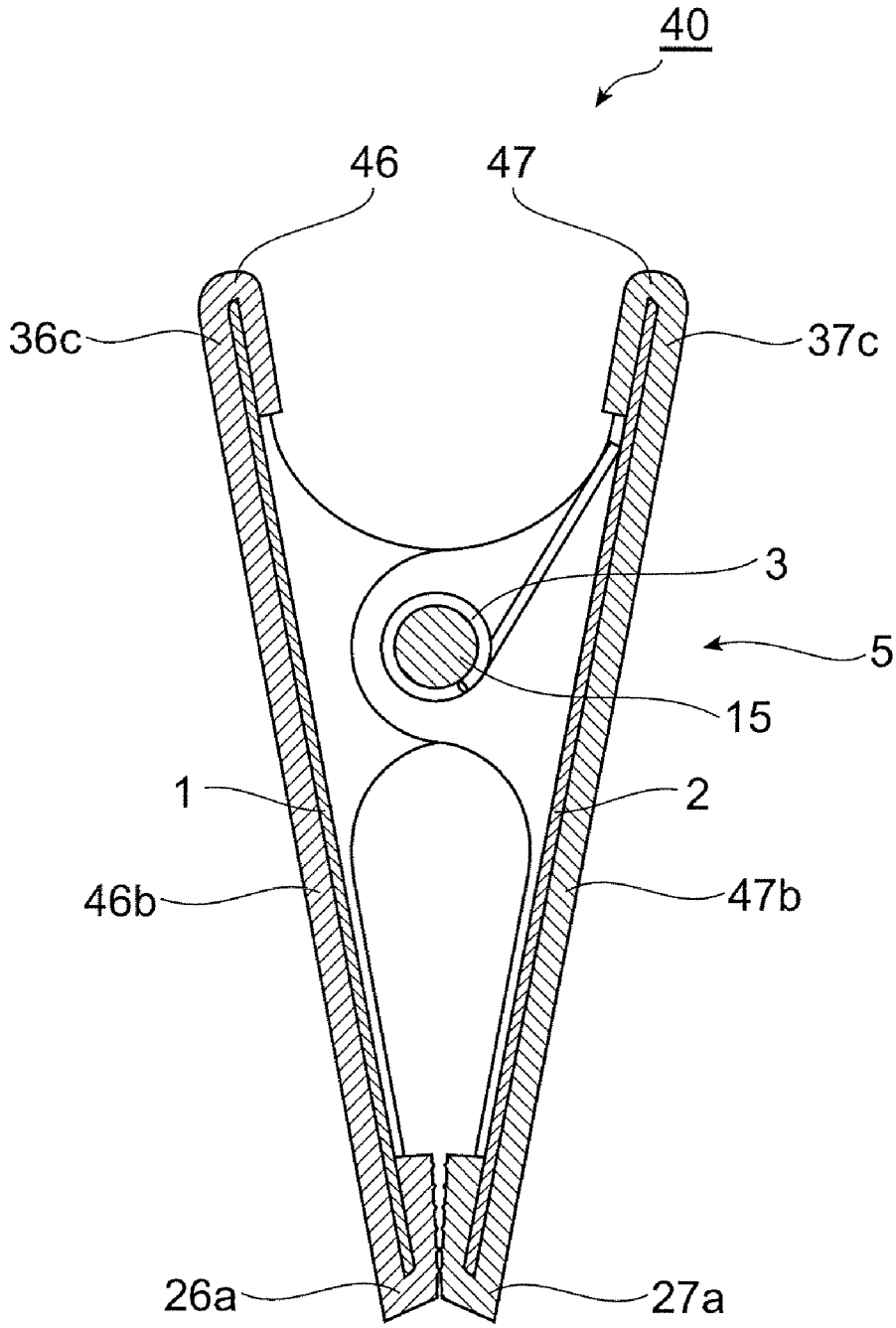
FIG. 8 is a cross-sectional diagram illustrating a fourth embodiment of the clip according to the present invention.

FIG. 8 is a cross-sectional diagram illustrating a fourth embodiment of the clip of the present invention. Clamping force increasing members 46, 47 of the clip 40 of the present embodiment have transmission sections 46*b*, 47*b* disposed along the outer faces of the clip members 1, 2, respectively. Otherwise, the clip 40 has the same constitution as the clip 30.

Figure 9:
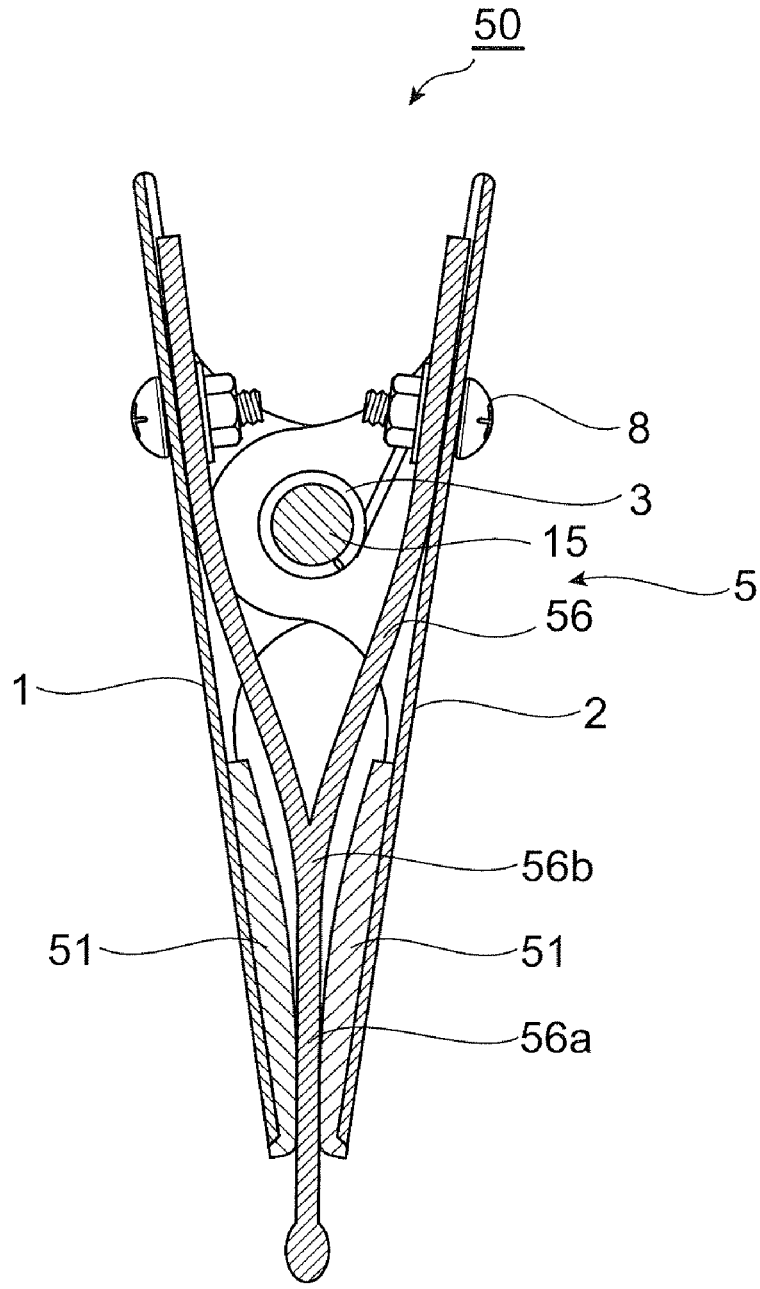
FIG. 9 is a cross-sectional diagram illustrating a fifth embodiment of the clip according to the present invention.
Figure 10:
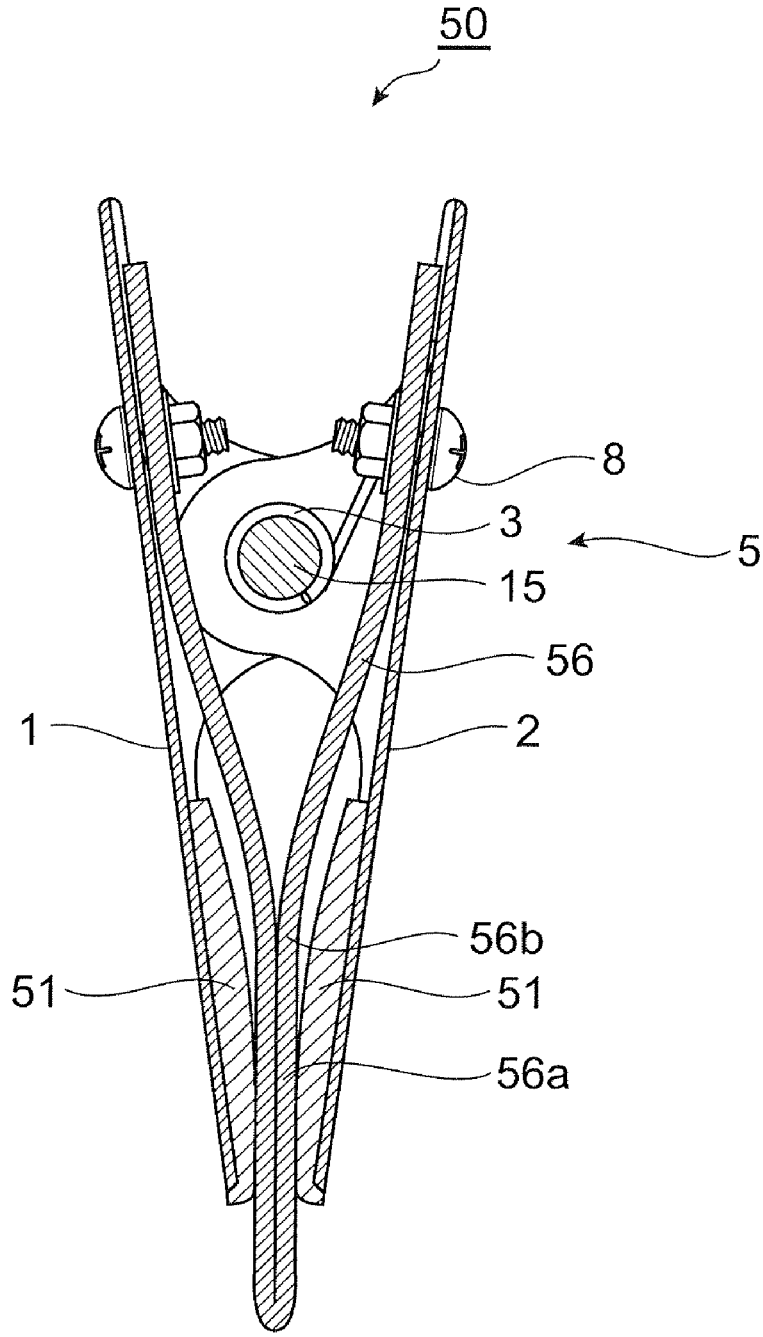
FIG. 10 is a cross-sectional diagram illustrating a modification of the fifth embodiment of the clip according to the present invention.

FIG. 9 is a cross-sectional diagram illustrating a fifth embodiment of the clip of the present invention. The clip 50 according to the fifth embodiment comprises one clamping force increasing member 56. A slip prevention section 56*a* of the clamping force increasing member 56 is provided in such a manner that the distance therefrom to the clip members 1, 2 increases when the leading ends of the clip body 5 are open. That is, the shapes of the slip prevention section 56*a* and the transmission section 56*b* are equivalent to integrating part of the transmission sections and part of the slip prevention sections of the clamping force increasing members 6, 7 of the clip 10. Also, slip stoppers 51 are preferably provided in each of the clip members 1, 2 of the clip 50, at the portions in contact with the object. In the clip 50, the action of the clamping force increasing member 56 increases the clamping force of the clip body 5, while, in addition, the object can be prevented more effectively from coming off the clip thanks to the increased contact surface area between the object and the clip. The slip prevention section 56*a* may not necessarily comprise one layer. For instance, the slip prevention section can comprise one folded-back sheet, as illustrated in FIG. 10.

Figure 11:
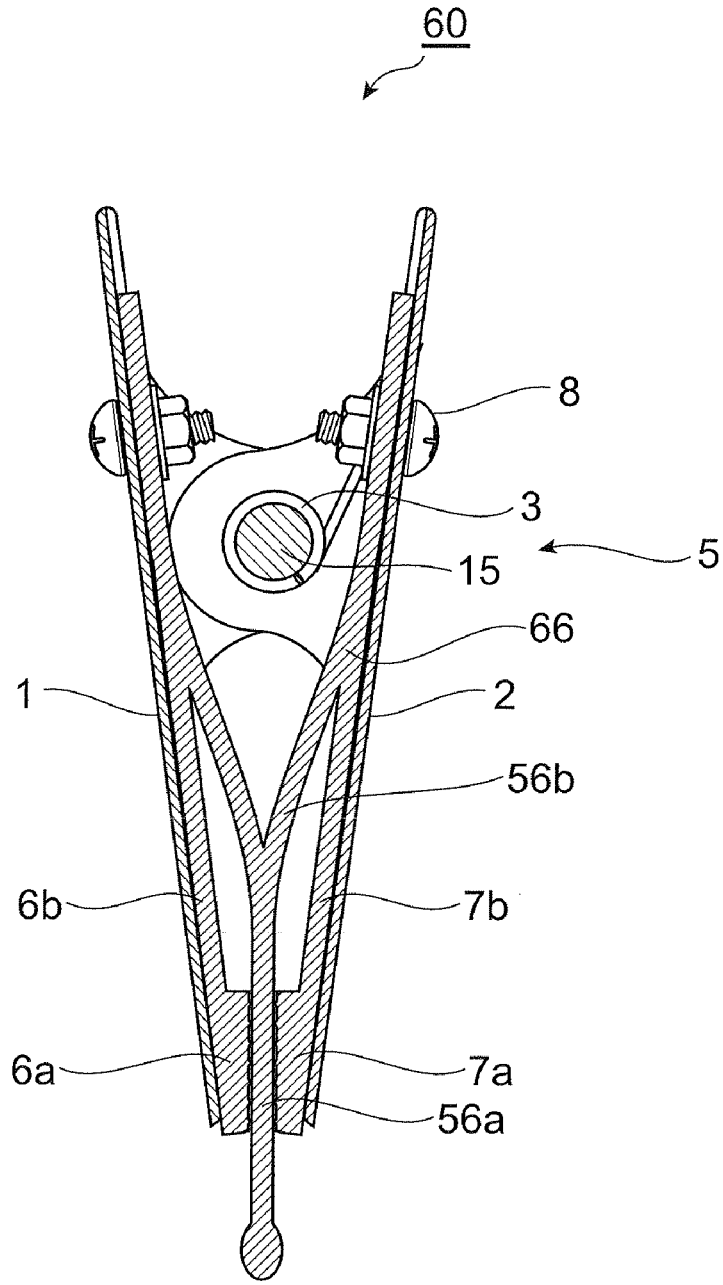
FIG. 11 is a perspective-view diagram illustrating a sixth embodiment of the clip according to the present invention.

FIG. 11 is a cross-sectional diagram illustrating a sixth embodiment of the clip of the present invention. A clamping force increasing member 66 of the clip 60 according to the sixth embodiment has a slip prevention section 56*a* provided in such a manner that the distance therefrom to the clip members 1, 2 increases when the leading ends of the clip body 5, and of slip prevention sections 6*a*, 7*a* slidably provided along the respective clip members 1, 2, are open. That is, the base end sides of the transmission sections of the clamping force increasing member 56 of the clip 50 are integrally connected with the clamping force increasing members 6, 7 of the clip 10. In the clip 60, the action of the clamping force increasing member 66 increases the clamping force of the clip body 5, while, in addition, the object can be prevented yet more effectively from coming off the clip thanks to the increased contact surface area between the object and the clip.

The clip body that can be used in the present invention is not limited to the clip body 5 used in the above-described embodiments. In the present invention there may be used clamping force increasing members and fixing means of appropriate constitution or shape according to the constitution of the clip body.

Figure 12:
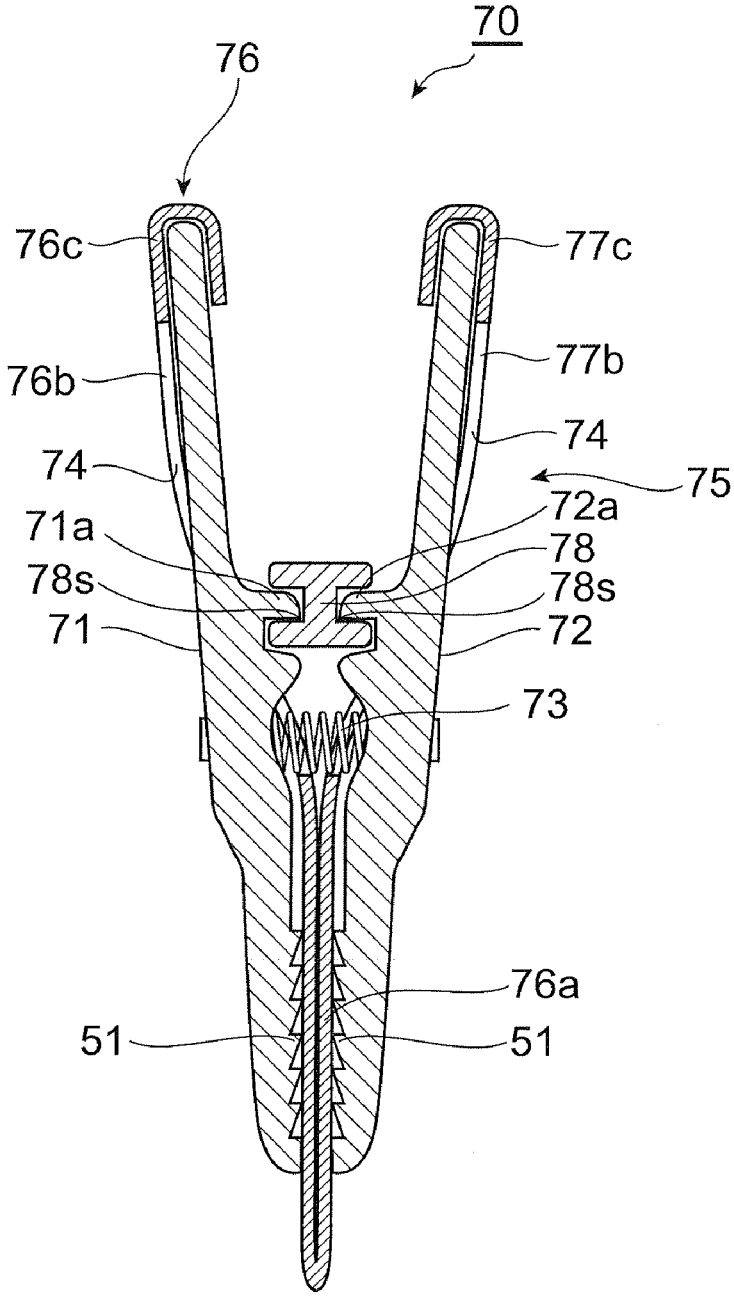
FIG. 12 is a cross-sectional diagram illustrating a seventh embodiment of the clip according to the present invention.

FIG. 12 is a cross-sectional diagram illustrating a seventh embodiment of the clip of the present invention. A clip body 75 of a clip 70 according to the present embodiment comprises a pair of clip members 71, 72; a core rod 78 in which there is formed a pivot fulcrum 78*s* into which there fit protrusions 71*a*, 72*a* of the clip members 71, 72; and a spring 73 that exerts on the clip members 71, 72 a pressing force for holding an object. The both ends of the spring 73, which is provided more towards the leading end than the core rod 78, are respectively fixed to the clip members 71, 72. When the leading ends of the clip body 75 are open, therefore, a force is generated in the direction in which the spring 73 contracts.

A clamping force increasing member 76 attached to the clip members 71, 72 comprises transmission sections 76*b*, 77*b* having an opening 74 for insertion of the clip members 71, 72; fixing means 76*c*, 77*c* provided on the base end sides of the transmission sections and shaped in such a manner so as to cover part of the base end sides of the clip members 71, 72; and a slip prevention section 76*a* having a structure of one folded-back sheet. In a modification of the clip 70, the clip members 71, 72 may have an opening into which the clamping force increasing member 76 is inserted.

Figure 13:
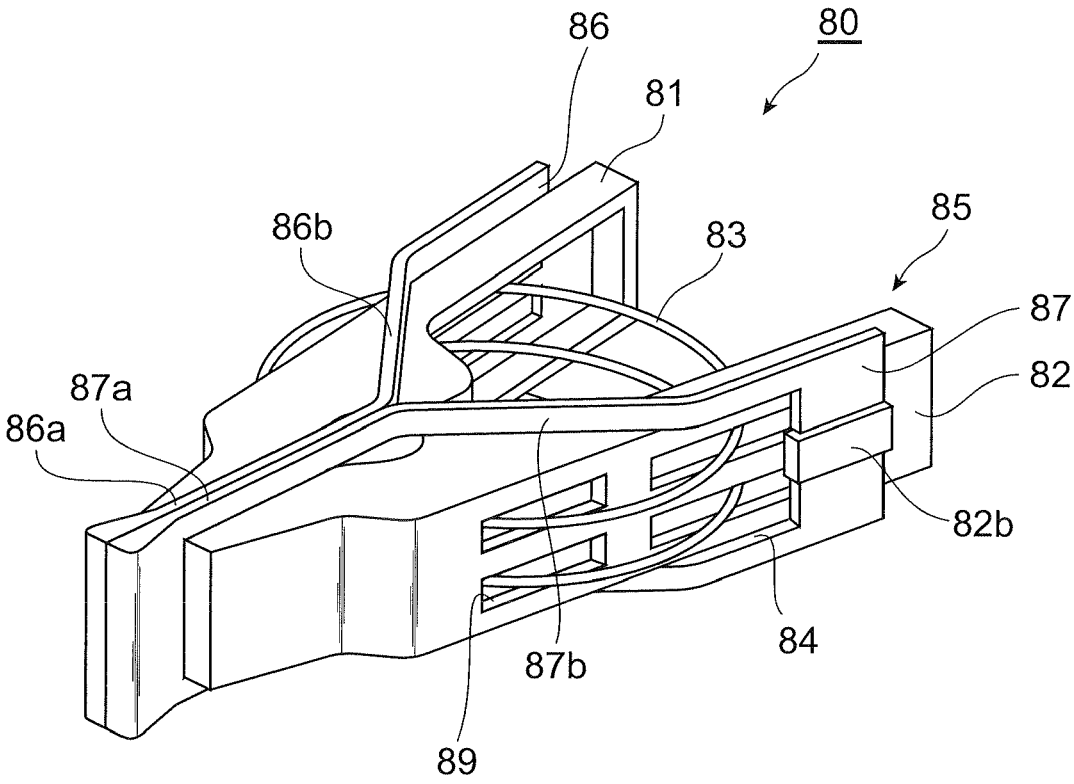
FIG. 13 is a perspective-view diagram illustrating an eighth embodiment of the clip according to the present invention.
Figure 14:
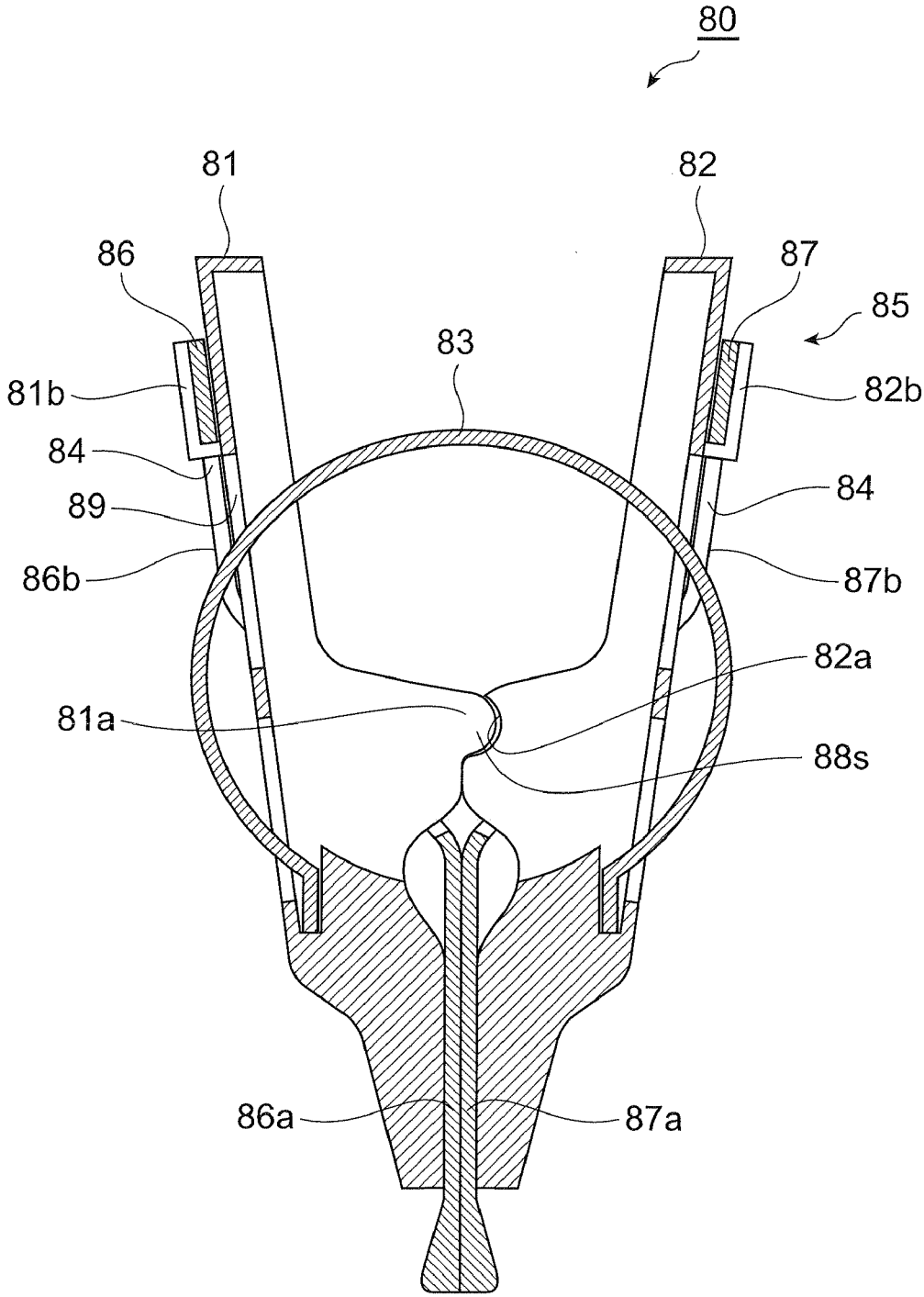
FIG. 14 is a cross-sectional diagram illustrating the eighth embodiment of the clip according to the present invention.

FIG. 13 is a perspective-view diagram illustrating an eighth embodiment of the clip of the present invention, and FIG. 14 is a cross-sectional diagram of a clip 80 according to the embodiment. A clip body 85 of the clip 80 comprises a pair of clip members 81, 82, and a C-shaped elastic member 83 that exerts on the clip members 81, 82 pressing force for holding an object. The clip members 81, 82 have respective fitting sections 81*a*, 82*a* that make up a pivot fulcrum 88*s*. The clip members 81, 82 have plural openings 89 for arranging the elastic member 83.

Transmission sections 86*b*, 87*b* of the clamping force increasing members 86, 87 of the clip 80 have respective openings 84 into which the clip members 81, 82 are inserted. The clamping force increasing members 86, 87 are supported on the clip members 81, 82 by way of hooks 81*b*, 82*b* (fixing means) respectively provided outside the clip members 81, 82. The shape of slip prevention sections 86*a*, 87*a* of the clamping force increasing members 86, 87 is not limited to a plate-like shape, and may be shaped so as to cover part of the leading ends of the clip members 81, 82, as in the clip 20. Also, parts of the slip prevention sections 86*a*, 87*a* may be formed integrally into a single body, or may be connected to each other. As is the case in the clip 30, the fixing means may be provided on the base end side of the transmission sections 86*b*, 87*b* and be shaped in such a manner so as to cover part of the bases of the clip members 81, 82.

Figure 15:
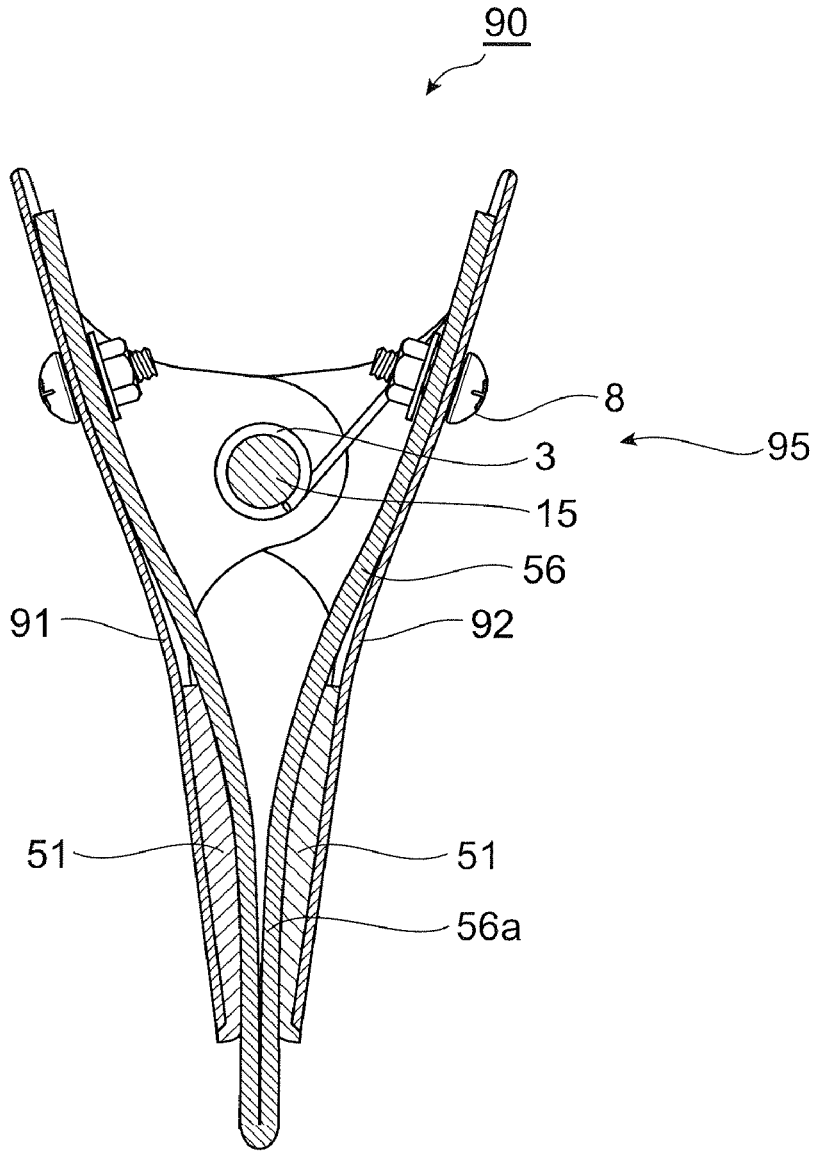
FIG. 15 is a cross-sectional diagram illustrating a ninth embodiment of the clip according to the present invention.

In terms of increasing clamping force, the present invention preferably uses a clip body in which the angle formed by the pair of clip members is greater than that of the above clip body 5, or a clip body 95 such as that of a clip 90 illustrated in FIG. 15, in which a pair of clip members 91, 92 are curved outwards. The reason for this is that the torque that causes the clip members to rotate increases as does the distance from the pivot fulcrum and the positions at which the clip members are fixed.

Figure 16:
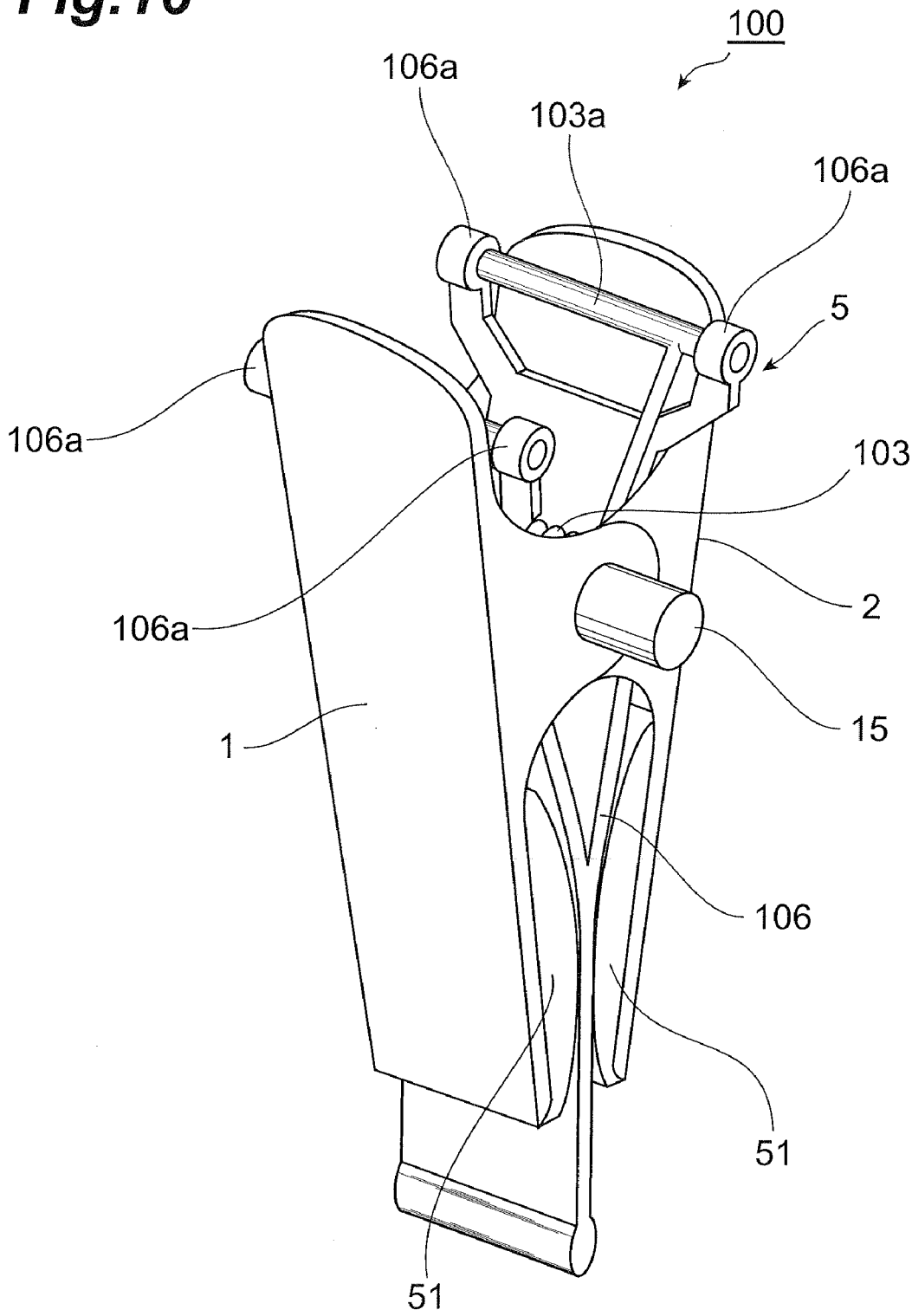
FIG. 16 is a cross-sectional diagram illustrating a tenth embodiment of the clip according to the present invention.

FIG. 16 is a cross-sectional diagram illustrating a tenth embodiment of the clip of the present invention. A clip 100 according to the tenth embodiment differs from the clip 50 in that herein a clamping force increasing member 106 is fixed on both ends of a spring 103. A plurality of ring sections 106*a* are provided on the base end side of the clamping force increasing member 106, while rods 103*a* are provided at both ends of the spring 103. The clamping force increasing member 106 is fixed to the spring 103 by inserting the rods 103*a* into the ring sections 106*a*. The shape of the clamping force increasing member of the tenth embodiment is not limited to the shape illustrated in FIG. 16, provided that it is a shape that allows fixing to the spring 103. The shape of other portions may be that of any of the clamping force increasing members explained in the above embodiments.

The hanger of the present invention comprises the above-described clip of the present invention. Other than for the clip, the constitution of the hanger may be any conventionally known constitution.

Figure 17:
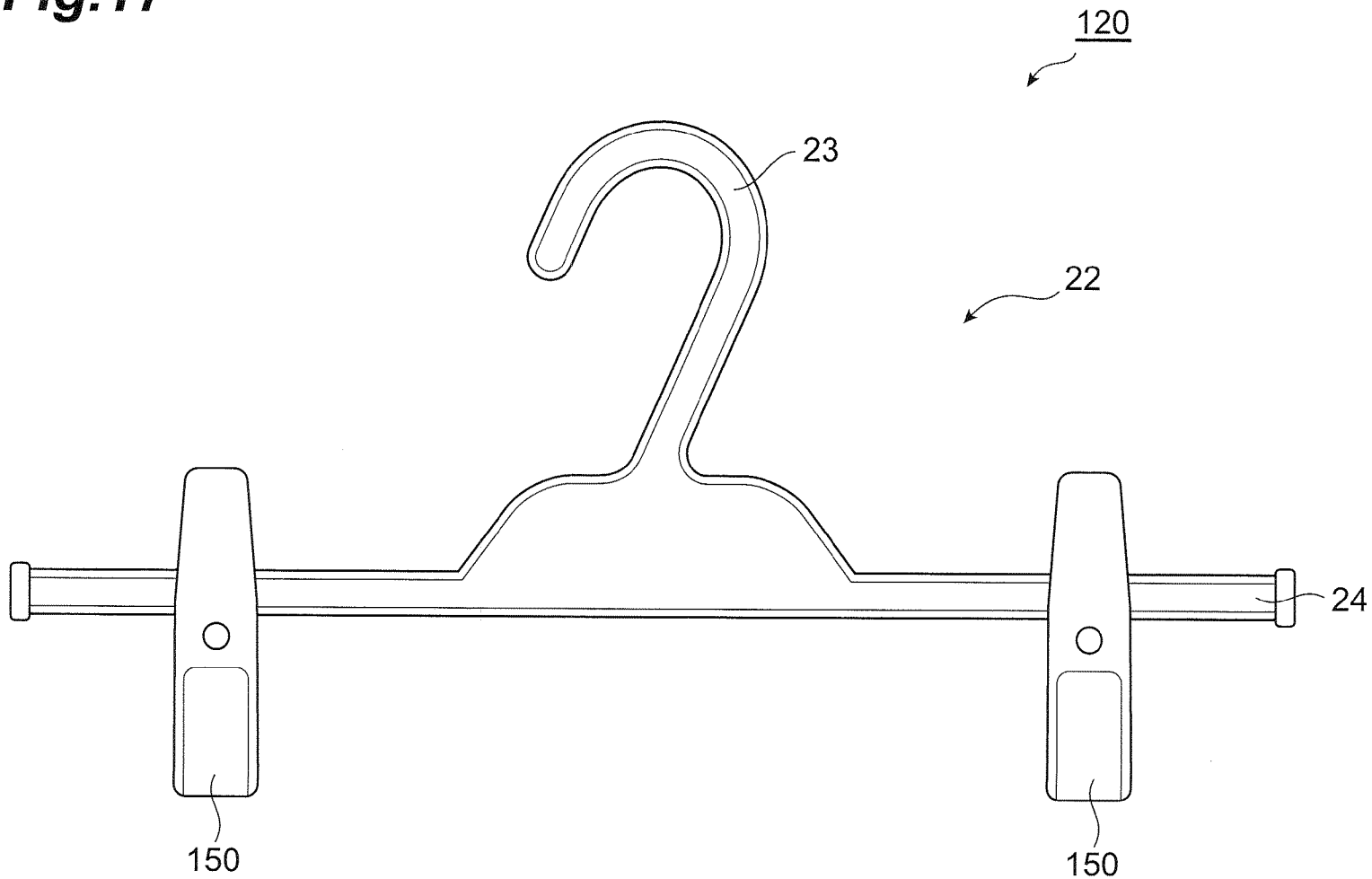
FIG. 17 is a front-view diagram illustrating a preferred embodiment of the hanger according to the present invention.

FIG. 17 is a front-view diagram illustrating a preferred embodiment of the hanger of the present invention. A hanger 120 according to the present embodiment comprises any clips 150 of the present invention and a hanger body 22. The hanger body 22 comprises a hook 23 and a bar 24. The bar 24, which functions also as a core rod of the clips 150, connects the hook 23 and the clips 150. When using a clip 80 that requires no core rod, the clip 80 and the bar 24 may be connected by way of a chain or the like.

Figure 18:
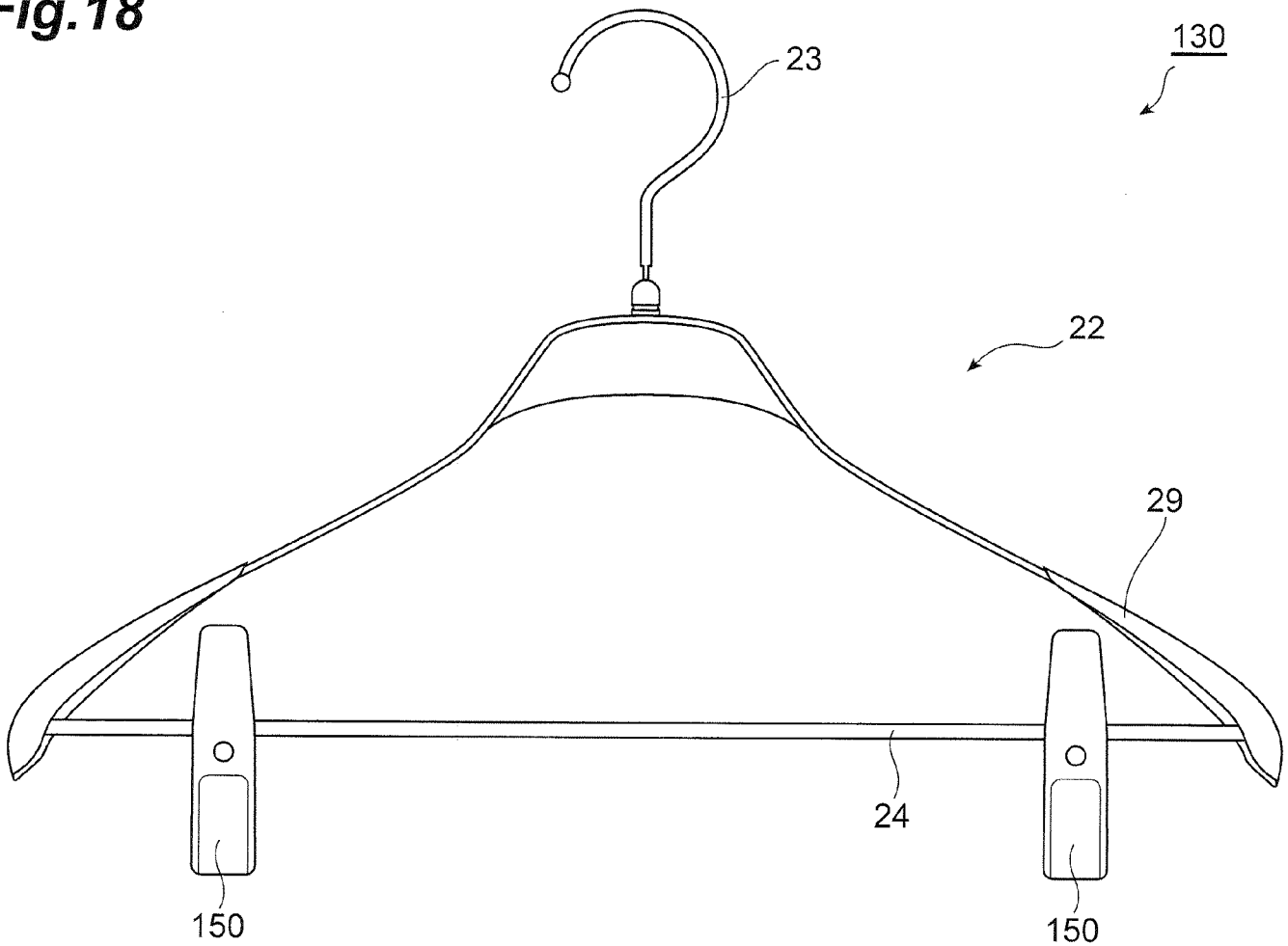
FIG. 18 is a front-view diagram illustrating another preferred embodiment of the hanger according to the present invention.

FIG. 18 is a front-view diagram illustrating another preferred embodiment of the hanger of the present invention. A hanger 130 according to the present embodiment differs from the hanger 120 in that the hanger 130 comprises a clothes hanging section 29 for hanging clothing articles such as a shirt, a jacket or the like.

The use of the clip of the present invention is not limited to clothing articles. The clip of the present invention is suitable as an office clip and may be used for bundling paper or the like.

The present invention provides thus a clip whose clamping force increases when an object clamped by the clip is pulled away from the clip. The clip according to the present invention can effectively prevent a clothing article from coming off the clip. In addition, the increase in clamping force of the clip of the present invention can be made to be temporary, which as a result allows sufficiently suppressing formation of marks on the portions of the clothing article clamped by the clip. The present invention provides also a hanger comprising the above-described clip.

The invention claimed is:

1. A clip for clamping an object, comprising:

a clip body including a pair of clip members are pivotally connected to each other at a pivoting point, each clip member including a first segment disposed on one side of the pivoting point and a second segment disposed on the other side of the pivoting point, said first segments have respective leading ends forming a clamping end;

a clamping force increasing member for increasing a clamping force of the clip body; and fixing means for supporting the clamping force increasing member on the clip body, wherein the clamping force increasing member has a slip prevention section, disposed between said leading ends and clamped by the clamping end together with the object, and a transmission section connected to the slip prevention section and fixed by the fixing means to the respective second segment of at least one clip member of the pair of clip members, and the fixing means transmits to the clip body, via the transmission section, a friction force that the slip prevention section receives from the object.

2. The clip according to claim 1, wherein the clip comprises two slip prevention sections, the slip prevention sections being provided respectively abutting the pair of clip members and being respectively slidable along the pair of clip members, and the object is clamped between the two slip prevention sections.

3. The clip according to claim 1, wherein the slip prevention section is provided so as to be apart from the pair of clip members when the leading ends are open, and the object is clamped between the slip prevention section and the pair of clip members.

4. A clip for clamping an object, comprising:

a clip body in which a pair of clip members are pivotally connected to each other at a pivoting point, each clip member having a first segment on one side of the pivoting point and a second segment in the other side of the pivoting member;

a spring disposed between the pair of clip members, both ends of the spring abutting respective second segments of the clip members, to impart thereby a clamping force to the clip body;

a clamping force increasing member for increasing the clamping force of the clip body, and fixing means for supporting the clamping force increasing member on the clip body, wherein the clamping force increasing member has a slip prevention section, disposed between leading ends of the clip body and clamped by the clip body together with the object, and a transmission section connected to the slip prevention section and fixed by the fixing means to at least one of the both ends of the spring, and the fixing means transmits to the clip body, via the transmission section and the spring, a friction force that the slip prevention section receives from the object.

5. A hanger comprising a clip and a hanger body for attaching the clip, wherein the clip includes a clip body in which a pair of clip members are pivotally connected to each other at a pivoting point and include respective first segments disposed on one side of the pivoting point to define a leading end for said clip body, and respective second ends disposed on the other side of the pivoting point;

a clamping force increasing member for increasing a clamping force of the clip body; and fixing means for supporting the clamping force increasing member on the clip body, wherein the clamping force increasing member has a slip prevention section disposed between the clip members at the leading end of the clip body and clamped by the clip body together with the object, and a transmission section connected to the slip prevention section and fixed by the fixing means to at least the second segment of one clip member of the pair of clip members, and the fixing means transmits to the clip body, via the transmission section, a friction force that the slip prevention section receives from the object; and the hanger body has a hook for hanging the hanger, and a bar connected to the hook and being a pivot fulcrum of the clip.

6. A hanger comprising a clip and a hanger body for attaching the clip, wherein the clip includes a clip body in which a pair of clip members are pivotally connected to each other at a pivoting point; and having respective first segments with clip member ends defining a leading edge for the clip body and respective second segments, said pivoting point being provided between said first and said second segments of said pair of clip members;

a spring disposed between the pair of clip members arranged to impart a clamping force to the clip body;

a clamping force increasing member for increasing the clamping force of the clip body, and a fixing member for attaching the clamping force increasing member to the second segment of one of the clipping members, wherein the clamping force increasing member has a slip prevention section, disposed between clip member ends and clamped together with the object, and a transmission section connected to the slip prevention section;

the fixing member and the transmission section cooperating to transmit to the clip body, and the spring, a friction force that the slip prevention section receives from the object; and the hanger body has a hook for hanging the hanger, and a bar connected to the hook and being a pivot fulcrum of the clip.

7. A clip for clamping an object, comprising:

a clip body in which a first and a second clip member are pivotally connected to each other at a pivoting point, each clip member having a first segment, said first segments each having a segment end, said segment ends defining a leading end for said clip body, and a second segment disposed on the opposite side of said pivoting point with respect to said leading end;

a spring disposed between first and second clip members and arranged to impart a clamping force between said first and second clip members at said leading end by urging said segment ends toward each other;

a first clamping force increasing member for increasing the clamping force of the clip body; and a first fixing member;

wherein the first clamping force increasing member has a slip prevention section disposed between the first segments and clamped by the clip body together with the object, and a transmission section connected to the slip prevention section and attached by the first fixing member to at least one of the second segments, the first clamping force increasing member and the first fixing member being constructed and arranged to transmit a friction force to the first fixing member in a direction that increases the clamping force of the clip body, the friction force being generated by the weight of the object being clamped by the clip body.

8. The clip of claim 7 further comprising a second fixing member, wherein said first clamping force increasing member includes a single slip prevention section disposed between said first segment ends and two transmission sections connected to said single slip prevention section, each transmission section being attached to the respective second segment of said first and second clip members by said first and second fixing members, respectively.

9. The clip of claim 8 wherein each said segment end is provided with a pad facing said slip prevention section.

10. The clip of claim 7 further comprising a second clamping force increasing member and a second fixing member, each said clamping force increasing member including a respective slip prevention member cooperating with the first and second fixing members, respectively, to transmit the friction force to said first and second clip members.

* * * * *